US009850708B2

(12) United States Patent
Bowley

(10) Patent No.: US 9,850,708 B2
(45) Date of Patent: Dec. 26, 2017

(54) DRILL STRING SUB

(71) Applicant: Tesco Corporation, Houston, TX (US)

(72) Inventor: Ryan Thomas Bowley, Calgary (CA)

(73) Assignee: Tesco Corporation, Houston, TX (US)

( * ) Notice: Subject to any disclaimer, the term of this patent is extended or adjusted under 35 U.S.C. 154(b) by 551 days.

(21) Appl. No.: 14/462,212

(22) Filed: Aug. 18, 2014

(65) Prior Publication Data

US 2016/0047168 A1 Feb. 18, 2016

(51) Int. Cl.

| | |
|---|---|
| ***E21B 44/02*** | (2006.01) |
| ***E21B 3/025*** | (2006.01) |
| ***E21B 47/09*** | (2012.01) |

(52) U.S. Cl.

CPC ..... *E21B 3/025* (2013.01); *E21B 47/09* (2013.01)

(58) Field of Classification Search

CPC ..... E21B 44/00; E21B 7/068; E21B 44/04; E21B 7/04; E21B 44/005; E21B 44/02; E21B 7/06; E21B 3/02; E21B 3/025

See application file for complete search history.

(56) References Cited

U.S. PATENT DOCUMENTS

| | | | | |
|---|---|---|---|---|
| 6,050,348 | A * | 4/2000 | Richarson | E21B 7/068 175/26 |
| 6,918,453 | B2 * | 7/2005 | Haci | E21B 7/068 175/26 |
| 7,152,696 | B2 * | 12/2006 | Jones | E21B 44/00 175/40 |
| 8,561,720 | B2 * | 10/2013 | Edbury | E21B 7/06 175/26 |
| 2005/0274548 | A1 * | 12/2005 | Albert | E21B 3/025 175/61 |
| 2011/0162891 | A1 * | 7/2011 | Camp | E21B 7/067 175/61 |
| 2014/0262514 | A1 * | 9/2014 | Beylotte | E21B 44/00 175/40 |
| 2016/0084011 | A1 * | 3/2016 | Blange | E21B 7/04 175/61 |

* cited by examiner

*Primary Examiner* — Kipp C Wallace
(74) *Attorney, Agent, or Firm* — Fletcher Yoder, P.C.

(57) ABSTRACT

The present disclosure is directed to a drilling system including a drill string with two or more drill pipes (e.g., tubular), a drive system configured to rotate the drill string, and a neutral point sub disposed proximate a neutral point of the drill string, where the neutral point sub is configured to detect motion of the drill string.

19 Claims, 3 Drawing Sheets

10
20
22
14
18
40
42
56
38
58
52
50
CONTROL SYSTEM
26
36
34
32
66
54
64
12
28
24
16
44
47
30
63
57
62
60

DRILL STRING SUB

BACKGROUND

Embodiments of the present disclosure relate generally to the field of drilling and processing of wells. More particularly, present embodiments relate to a system and method for determining the presence of and controlling motion (e.g., rotation) of a drill string in a drilling rig.

During a drilling process, the drill string may be supported and hoisted about the drilling rig by a hoisting system for eventual positioning down hole in a well (e.g., a wellbore). As the drill string is lowered into the well, a drive system may rotate the drill string to facilitate drilling. Further, at the end of the drill string, a bottom hole assembly (BHA) and a drill bit of the BHA may press into the ground to drill the wellbore. Maintaining a desired weight on bit (WOB), which is a desired amount of weight on the drill bit, may enhance the drilling processes. In particular, maintaining a high rate of penetration without damaging the BHA is desired.

In many drilling processes, the wellbore may include vertical and directional segments. For example, the drill string may initially drill a first vertical segment to a desired depth by utilizing the top drive, the weight of the drill string, and/or a mud motor. In order to drill a directional section or segment, the top drive may be stopped from exerting a force on the drill string, but may be used to hold a position of the drill string. The mud motor of the drill bit may then be adjusted to drill a directional segment at a desired angle, e.g., a horizontal segment. Unfortunately, once the drill string is in the directional (e.g., horizontal) segment in particular, and in the vertical segment to an extent, the drill string may be susceptible to resting against or contacting sides of the wellbore, which may increase a frictional force against the drill string, causing the drill string to stick against the sides of the wellbore. As more weight is added to the drill string by lowering a drawworks of the drilling rig, the drill string may break free from the sides of the wellbore and fall into and contact an end of the wellbore, which may overload the drill bit proximate the end of the wellbore.

Thus, drilling the directional (e.g., horizontal) segment in particular, and the vertical segment to an extent, may be enhanced by inducing a rocking motion (e.g, alternating clockwise and counterclockwise rotations about a longitudinal axis of the drill string) in the drill string to reduce frictional forces between the sides of the wellbore and the drill string. The rocking motion may be induced by exerting a torque (e.g., rotation) at a top of the drill string via a top drive disposed on the drilling rig proximate the top of the drill string. Providing torque to the drill string in alternating clockwise and counterclockwise directions about the longitudinal axis, for a certain amount of turns (e.g., a certain amount of 360° rotations) in each direction, may decrease frictional forces between the drill string and the sides of the wellbore, particularly proximate directional (e.g., horizontal) segments, which may reduce a likelihood that the drill string slips.

It should be noted that the amount of rotation applied to the drill string at the top drive generally does not propagate all the way down the drill string. In other words, elasticity of the drill string, among other factors, causes the rotation to "dissipate" as rotation travels down the drill string. Thus, determining how far down the well bore the drill string actually rotates may not be trivial. Further, providing too many turns to the drill string via the top drive may result in adverse effects. For example, providing too many turns to the drill string may result in an undesired altered drilling angle. Conversely, applying too few turns to the drill string may result in inefficient drilling and may increase susceptibility of the drill string to frictionally engage with the wellbore and, ultimately, slip, as previously described. Thus, traditionally, operators have (a) determined a desired location (known as a "neutral point") on the drill string to which rotation of the drill string is intended to reach, and (b) employed engineering calculations to determine how many turns must be applied via the top drive to reach the neutral point. Unfortunately, such engineering calculations may be estimates, which, when applied, may result in an undesired altered drilling angle and/or slippage of the drill string. Accordingly, it is now recognized that there is a need for improved detection and maintenance of motion (e.g., rotation) of the drill string with respect to WOB.

BRIEF DESCRIPTION

In a first embodiment, a drilling system includes a drill string with two or more drill pipes (e.g., tubular), a drive system configured to rotate the drill string, and a neutral point sub disposed proximate a neutral point of the drill string, where the neutral point sub is configured to detect motion of the drill string.

In a second embodiment, a method of controlling rotation of a drill string includes detecting rotation of the drill string at a neutral point of the drill string in a first circumferential direction about a longitudinal axis of the drill string via a neutral point sub disposed on the drill string. The method also includes instructing a drive system, via a controller, to stop rotating the drill string in the first circumferential direction after detecting the rotation of the drill string at the neutral point. The method also includes instructing the drive system, via the controller, to start rotating the drill string in a second circumferential direction substantially opposite to the first circumferential direction after stopping the rotation of the drill string in the first circumferential direction.

In a third embodiment, a method of drilling a well includes instructing a top drive, via a controller, to apply a torque to a drill string in a first circumferential direction relative to a longitudinal axis extending through the drill string. The method includes detecting rotation of the drill string at a neutral point of the drill string below the top drive via a neutral point sub, and sending a pulse, via the neutral point sub, to a controller to alert the controller that the neutral point sub has detected rotation of the drill string at the natural point. The method also includes processing the pulse via the controller and instructing the top drove, via the controller, to apply torque to the drill string in a second circumferential direction relative to the longitudinal direction, where the second circumferential direction is substantially opposite the first circumferential direction.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
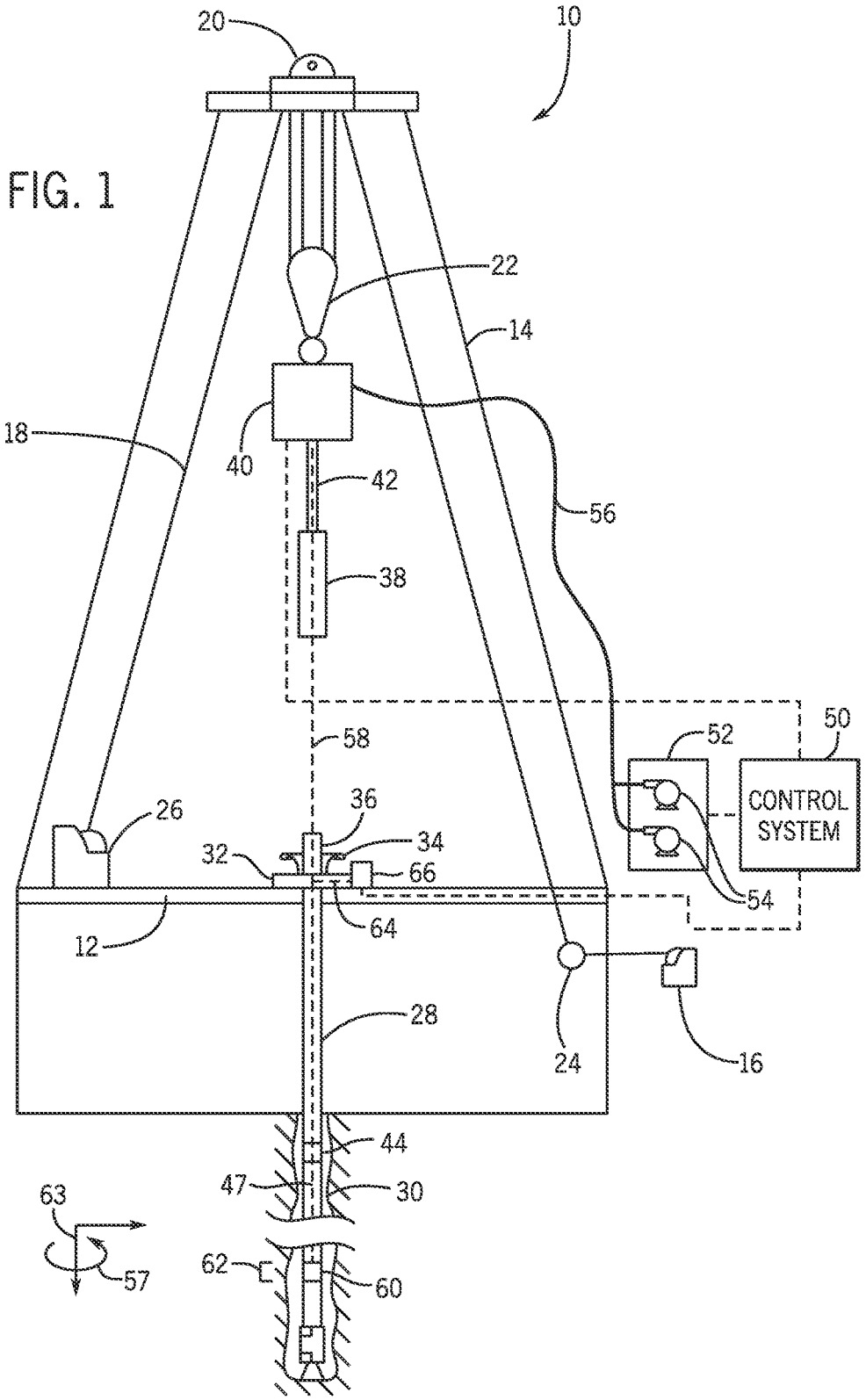
FIG. 1 is a schematic representation of a drilling rig with a neutral point sub in accordance with present embodiments.

Various drilling techniques can be utilized in accordance with embodiments of the present disclosure. In conventional oil and gas operations, a well is typically drilled to a desired depth with a drill string, which includes drill pipe (e.g., tubular, drill collars, etc.) and a drilling bottom hole assembly (BHA) that includes a drill bit. During a drilling process, the drill string may be supported and hoisted about a drilling rig by a hoisting system for eventual positioning down hole in a well. As the drill string is lowered into the well, a drive system may rotate the drill string to facilitate drilling. The drive system typically includes a rotational feature (e.g., a drive shaft or quill) that transfers torque to the drill string. For example, a top drive may generate torque and utilize a quill to transfer the torque to the drill string. The torque may apply rotation to the drill string, such that the drill string rotates through frictional forces between the drill string and sides of the wellbore. By reducing frictional forces between the drill string and the sides of the wellbore, slippage of the drill string may be reduced or eliminated.

As described above, the drive system may operate to rotate the drill string about a longitudinal axis of the drill string by the drive system. For example, the drive system may rotate the drill string in a "rocking motion," or, in other words, in alternating clockwise and counterclockwise directions about a longitudinal axis extending through the drill string. The drill string may be rotated a certain number of turns (e.g., 360° turns) or a certain number of degrees in the clockwise direction and then a certain number of turns or degrees in the counterclockwise direction. In some embodiments, the number of turns or degrees in the clockwise direction may be substantially the same number of turns or degrees in the counterclockwise direction.

In general, the drilling process may be made more effective by ensuring that the drill string does not rotate beyond a neutral point (a point along the drill string where no rotation is desired) of the drill string. If the drill string rotates beyond the neutral point (e.g., as the rotations propogate downward from the top drive above the neutral point), adverse effects may occur. For example, rotating the drill string beyond the neutral point may result in an undesired change in the drilling angle. Alternatively, if rotations of the drill string from above the neutral point do not propagate through the drill string up to the neutral point, the drill string may frictionally engage with sides of the well bore and, eventually, may "slip" from the frictional engagement, causing the drill string to fall down the wellbore and overload the drill bit.

Thus, in accordance with the present disclosure, a neutral point sub may be placed at the neutral point of the drill string for detecting motion (e.g., rotation) in the drill string. The neutral point sub may be a threaded connector configured to fit between two pieces of pipe (e.g., two sections of tubular or drill collars) of the drill string. For example, the neutral point may be pre-determined based on a total length of the drill string, among other factors, and the neutral point sub may be placed proximate the neutral point of the drill string between two pipes of the drill string. Additionally, subs may be located between every connection of pipes (or between more than one connection of pipes) of the drill string and may be configured to operate as the neutral point sub when activated or in a similar manner as the neutral point sub at any given time, and the appropriate sub may be activated as the neutral point sub depending on the determined neutral point location at any given time during the drilling process.

The neutral point sub in the presently contemplated embodiment is configured to detect rotation of the pipe (e.g., drill string) coupled to the neutral point. Further, the neutral point sub is configured to provide feedback of detected rotation, such that an appropriate amount of rotation may be applied to the drill string in the rocking motion by the top drive. Accordingly, the neutral point sub is configured to enable more efficient drilling (e.g., by allowing the drill string to rotate just up to or slightly beyond the neutral point, as described above) and to enable more accurate drilling (e.g., by ensuring the drill string does not rotate through or excessively beyond the neutral point, as described above).

Turning now to the figures, FIG. 1 is a schematic representation of a drilling rig 10 in the process of drilling a well in accordance with present techniques. The drilling rig 10 features an elevated rig floor 12 and a derrick 14 extending above the rig floor 12. A supply reel 16 supplies drilling line 18 to a crown block 20 and traveling block 22 configured to hoist various types of drilling equipment above the rig floor 12. The drilling line 18 is secured to a deadline tiedown anchor 24, and a drawworks 26 regulates the amount of drilling line 18 in use and, consequently, the height of the traveling block 22 at a given moment. Below the rig floor 12, a drill string 28 extends downward into a wellbore 30 and is held stationary with respect to the rig floor 12 by a rotary table 32 and slips 34. A portion of the drill string 28 extends above the rig floor 12, forming a stump 36 to which another length of tubular 38 may be added. The drill string 28 may include multiple sections of threaded tubular 38 (e.g., pipes, collars, etc.) that are threadably coupled together. It should be noted that present embodiments may be utilized with drill pipe, casing, or other types of tubular. Further, it should be noted that saver subs may be disposed between any two threaded tubular 38 of the drill string 28.

During operation, a top drive 40, hoisted by the traveling block 22, may engage and position the tubular 38 above the wellbore 30. The top drive 40 may then lower the coupled tubular 38 into engagement with the stump 36 and rotate the tubular 38 such that it connects with the stump 36 and becomes part of the drill string 28. Specifically, the top drive 40 includes a quill 42 used to transfer torque to (e.g., turn) the tubular 38 or other drilling equipment. After setting or landing the drill string 28 in place such that the male threads of one section (e.g., one or more joints) of the tubular 38 and the female threads of another section of the tubular 38 are engaged, the two sections of the tubular 38 may be joined by rotating one section relative to the other section (e.g., in a clockwise direction) such that the threaded portions tighten together. In some embodiments, a sub 44 (e.g., a saver sub) may be placed between the two tubulars 38 for coupling the tubular 38. Thus, the two sections of tubular 38 may be threadably joined, together or via a sub 44 between the sections of tubular 38.

While FIG. 1 illustrates the drilling rig 10 in the process of adding the tubular 38 to the drill string 26, as would be expected, the drilling rig 10 also functions to drill the wellbore 30. Indeed, the drilling rig 10 includes a drilling control system 50 in accordance with the present disclosure. The control system 50 may coordinate with certain aspects of the drilling rig 10 to perform certain drilling techniques. For example, the drilling control system 50 may control and coordinate rotation of the drill string 28 via the top drive 40 and supply of drilling mud to the wellbore 30 via a pumping system 52. The pumping system 52 includes a pump or pumps 54 and conduit or tubing 56. The pumps 54 are configured to pump drilling fluid downhole via the tubing 56, which communicatively couples the pumps 52 to the wellbore 30. In the illustrated embodiment, the pumps 54 and tubing 56 are configured to deliver drilling mud to the wellbore 30 via the top drive 40. Specifically, the pumps 54 deliver the drilling mud to the top drive 40 via the tubing 56, the top drive 40 delivers the drilling mud into the drill string 28 via a passage through the quill 42, and the drill string 28 delivers the drilling mud to the wellbore 30 when properly engaged in the wellbore 30.

The control system 50 may also control rotation of the drill string 28 by instructing the top drive 40 to turn the drill string 28 about a longitudinal axis 58 extending through the drill string 28. For example, the control system 50 may instruct the top drive 40 to turn the drill string 28 a certain number of 360° turns in a circumferential direction 57 about the longitudinal axis 58 in the clockwise direction and then a certain number of 360° turns in the circumferential direction 57 about the longitudinal axis 58 in the counterclockwise direction. In some embodiments, the control system 50 may instruct clockwise and counterclockwise turns of less than 360° (e.g., a fraction of one 360° turn).

The control system 50 may interface with a neutral point sub 60 disposed between two sections of tubular 38 at a neutral point 62 of the drill string 28. It should be noted that the neutral point 62 may actually be a region that extends for some distance along the drill string 28 and that the neutral point sub 60 may be disposed within that region. The neutral point 62 may be a pre-calculated region where, to enhance the drilling process, the drill string 28 should not rotate.

The neutral point sub 60, in the illustrated embodiment, is disposed at the neutral point 62 for detecting rotations of the drill string 28 proximate the neutral point 62. Rotations may be applied to the drill string 28 via the top drive 40 in, for example, the clockwise direction about the longitudinal axis 58 of the drill string 28. However, the rotations may dissipate along the drill string 28 into the wellbore 30 as the drill string 28 extends downwardly (e.g., in longitudinal direction 63) along the longitudinal axis 58, due to, e.g., elasticity of the drill string 28. Accordingly, the drill string 28 may be rotated about the longitudinal axis 58 for a certain number of turns until the neutral point sub 60 first detects the rotation of the drill string 28. The neutral point sub 60 may, upon detection of rotation from the drill string 28 proximate the neutral point sub 60, provide feedback through a communication path 64 to the control system 50. For example, upon detection of rotation, the neutral point sub 60 may send an electric pulse through the communication path 64 to a port 66 disposed on or adjacent to the rotary table 32, where the port 66 may be electrically coupled to the control system 50. Alternatively, the neutral point sub 60, upon detection of rotation of the drill string 28 proximate the neutral point sub 60, may trigger a mud pulse through the communication path 64, which is detected by the control system 50, such that the control system 50 may stop rotation of the drill string 28 and rotate the drill string 28 in the other direction.

The control system 50 in the presently contemplated embodiment (e.g., as illustrated in FIG. 1) may receive the pulse from the neutral point sub 60 and instruct the top drive 40 to stop drill string 28 rotation (e.g., in the clockwise direction) and begin rotation in the other direction (e.g., in the counterclockwise direction) about the longitudinal axis 58 extending through the drill string 28. The process may be repeated for both the clockwise or counterclockwise direction. Accordingly, the neutral point sub 60 located at the neutral point 62 ensures that the drill string 28 rotates up to, but not beyond, the neutral point 62. Thus, the neutral point sub 60, together with the control system 50 and the top drive 40, enables efficient drilling by minimizing stick/slip between the drill string 28 and the sides of the wellbore 30, while maintaining an appropriate (e.g., desired) drilling angle.

Figure 2:
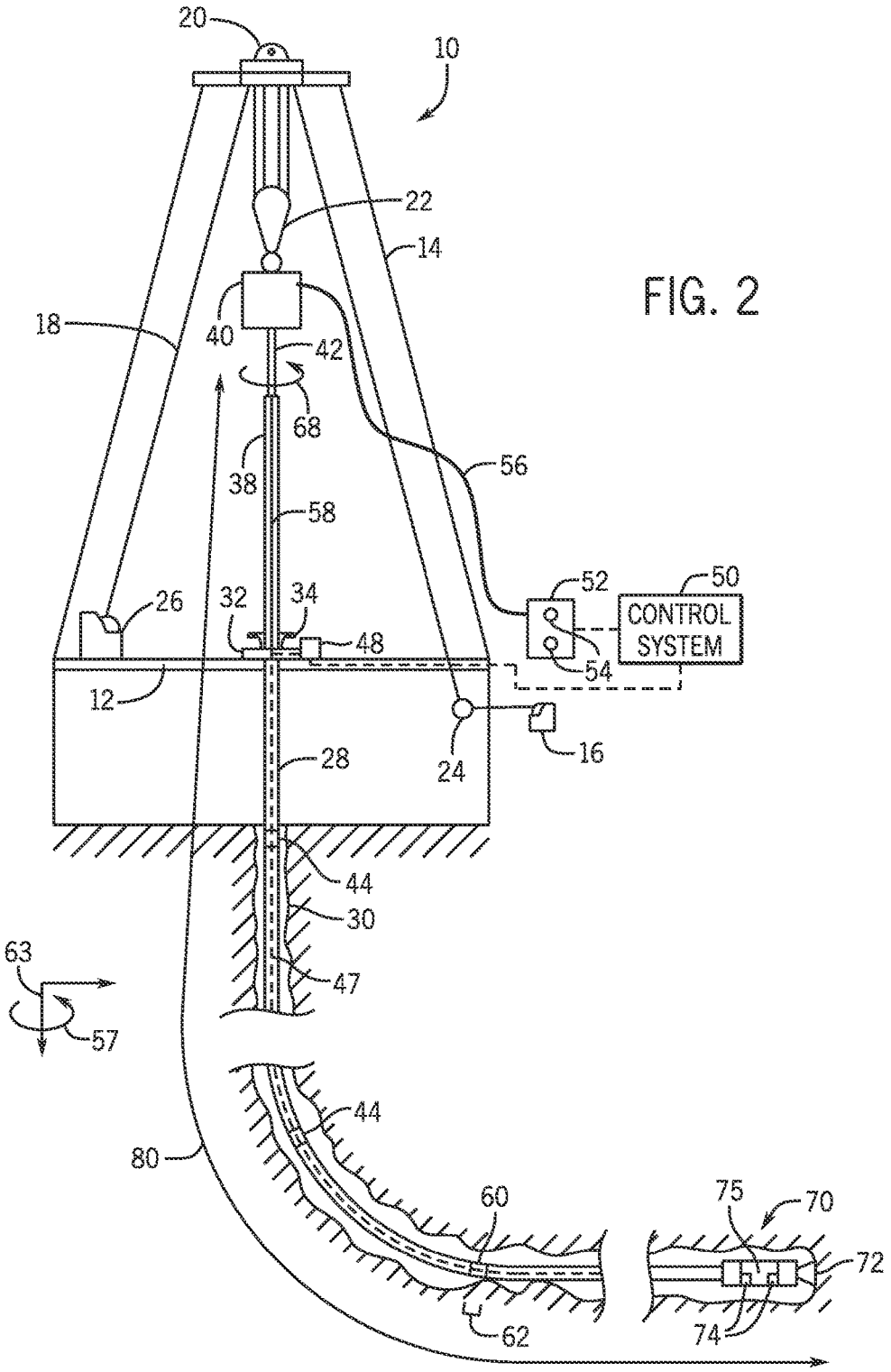
FIG. 2 is a schematic representation of a drilling rig with a neutral point sub in accordance with present embodiments.

FIG. 2 is a schematic representation of the drilling rig 10 during a directional drilling operation. In the illustrated embodiment, the top drive 40 is being utilized to transfer rotary motion to the drill string 28 via the quill 42, as indicated by arrow 68. In other embodiments, different drive systems (e.g., a rotary table, coiled tubing system, downhole motor) may be utilized to rotate the drill string 28 (or vibrate the drill string 28). Where appropriate, such drive systems may be used in place of the top drive 40. It should be noted that the illustrations of FIGS. 1 and 2 are intentionally simplified to focus on particular features of the drilling rig 10. Many other components and tools may be employed during the various periods of formation and preparation of the well. Similarly, as will be appreciated by those skilled in the art, the orientation and environment of the well may vary widely depending upon the location and situation of the formations of interest. For example, the well, in practice, may include one or more deviations, including angled and horizontal runs. Similarly, while shown as a surface (land-based) operation, the well may be formed in water of various depths, in which case the topside equipment may include an anchored or floating platform.

As will be discussed below, the drill string 28 may be rotated based on instructions from the control system 50, which may include automation and control features and algorithms for addressing static friction issues, such as stick slip, based on measurement data and equipment. For example, the control system 50 may control the rotation of the drill string 28 based on velocity profiles or vibration profiles generated in response to one or more variables including pipe size, size of hole, tortuosity, number of bends, type of bit, rotations per minute, mud flow, torque, bend setting, inclination, length of drill string, horizontal component of drill string, vertical component of drill string, mass of drill string, manual input, WOB, azimuth, tool face positioning, downhole temperature, downhole pressure, or the like. Further, the control system 50 may control the rotation of the drill string 28 based on feedback from the neutral point sub 60 described above and further described below. The control system 50 may include one or more automation controllers (e.g., programmable logic controllers (PLC)) with one or more processors and memories that cooperate to store received data and implement programmed functionality based on the data and algorithms. The control system 50 may communicate (e.g., via wireless communications, via dedicated wiring, or other communication systems) with various features of the drilling rig 10 or drill string 28 (e.g., the neutral point sub 60), not limited to the pumping system 52, the top drive 40, the drawworks 26, and downhole features (e.g., a bottom hole assembly 70 (BHA)).

In the illustrated embodiment, the drill string 28 includes the BHA 70 coupled to the bottom of the drill string 28. The BHA 70 includes a drill bit 72 that is configured for directional drilling. The drill bit 72 may include a bent axis motor-bit assembly or the like that is configured to guide the drill string 28 in a particular direction. Straight line drilling may be achieved by rotating the drill string 28 during drilling, and directional drilling may be achieved by adjusting the drill bit 72 such that it guides the drilling process without rotating the drill string 28. The BHA 70 includes sensors 74 configured to provide data (e.g., via pressure pulse encoding through drilling fluid, acoustic encoding through drill pipe, electromagnetic transmissions) to the control system 50 to facilitate control of this process, including determining whether to rotate the drill string 26 via the top drive 40 and/or pump drilling mud via the pumping system 52. For example, the sensors 74 may work in conjunction with or separately from the neutral point sub 60 to communicate with the control system 50 for controlling certain aspects of the drilling process, including pumping of mud via the pumping system 52 and rotation of the drill string 28 via the top drive 40. Thus, the control system 50 may instruct the top drive 40 to rotate the drill string 28 a certain amount of times in the clockwise and/or counterclockwise direction such that adverse force coupling does not occur or is reduced between forces exerted by the drill bit 72 on the drill string 28 and forces exerted by the top drive 40 on the drill string 28. Further, the pumping system 52 may supply drilling mud to a mud motor 75 (or drilling motor) of the BHA 70. The mud motor 75, which may represent multiple such motors, may include a progressive cavity positive displacement pump arranged to generate motion and to power the drill bit 72. The sensors 74, which may represent multiple different sensors, may detect upstream and downstream pressures relative to the mud motor 75 and provide related torque data (e.g., via the control system 50). It should be noted that, in some embodiments, aspects of the control system 50 may be positioned downhole (e.g., with the BHA 70) or integrated with other features (e.g., the top drive 40).

As illustrated in FIG. 2, the top drive 40 is being utilized to rotate the drill string 28. As noted above, the drill string 28 may frictionally engage with sides of the wellbore 30. Further, the drill string 28 and threaded connections between separate pipes (e.g., tubulars) of the drill string 28 may experience torsional loading from the top drive 40 and the drill bit 72, and axial loading from the weight of the drill string 28 (e.g., tubular of the drill string 28) and other components of the drilling rig 10. To reduce friction between the drill string 28 and sides of the wellbore 30, the top drive 40 may rotate the drill string 28 up to the neutral point 62. In doing so, susceptibility to slippage may be reduced or eliminated. The neutral point sub 60 may be included in accordance with the discussion above for ensuring that the top drive 40 does not rotate the drill string 28 at a point beyond the neutral point 62, as measured along the longitudinal axis 58 of the drill string 28 from the top drive 40, or top of the drill string 28. Thus, the desired drilling angle may be maintained.

In the illustrated embodiment, other subs 44 are included at various points along the drill string 28 between sections of tubular 38 of the drill string 28. These subs 44 may be capable of operating in the same way as the neutral point sub 60. In other words, the subs 44 may be capable of detecting rotation of the drill string 28 about the longitudinal axis 58 of the drill string 28 and may also be capable of communicating information related to that rotation to the control system 50. In some embodiments, the subs 44 may be identical or very similar to the neutral point sub 60. In this way, in the event the neutral point 62 location changes over time, another one of the subs 44 may be activated to become the neutral point sub 60 and the previous neutral point sub 60 may be deactivated to become another one of the subs 44. The neutral point sub 60 may be automatically determined from the group of subs 44 based on a length 80 of the drill string 28, as shown in the illustrated embodiment, among a number of other factors. Alternatively, the neutral point sub 60 may be selected from the group of subs 44 manually by an operator.

Including multiple subs 44 which may operate similarly as the neutral point sub 60 may offer certain other advantages as well. For example, in some embodiments, more than one of the subs 44 may be used to detect rotation of the drill string 28 over time. Each successive sub 44 may communicate with the control system 50 when it detects rotation of the drill string 28 such that the propagation of the rotation of the drill string 28 may be tracked over time. Accordingly, operators or the control system 50 may determine certain regions of the drill string 28 through which rotation propagation takes more time than other regions of the drill string 28. Such information may be processed by the control system 50 or used by an operator to enable a determination of locations or regions along the drill string 28 that experience more friction via engagement with sides of the wellbore 30 relative to other locations along the drill string 28.

Additionally, operators or the control system 50 may determine estimates of when the neutral point sub 60 disposed at the neutral point 62 will detect rotation of the drill string 28 based on feedback received via the subs 44 above the neutral point sub 60. For example, operators or the control system 50 may calculate a linear relationship, or some other mathematical function, between a number of turns applied to the drill string 28 by the drive system (e.g., the top drive 40) and a distance along the drill string 28 from the top drive 40 to the sub(s) 44 detecting rotation of the drill string 28. In other words, the linear relationship or mathematical function may compare the rotation propogation distance through the drill string 28 with the number of turns applied to the drill string 28 via the top drive 40 to reach said rotation propagation distance in order to determine an estimate of when the rotation will reach or approach the neutral point 62. Further, some of the subs 44 may be disposed at a point beyond the neutral point 62 (e.g., as measured from the top drive 40 down), such that the subs 44 may detect how far the drill string 28 has rotated beyond the neutral point 62 in the event the neutral point sub 60 malfunctions or some other component involved in the control system 50 malfunctions, or in the event a change in drilling angle is actually desired.

Figure 3:
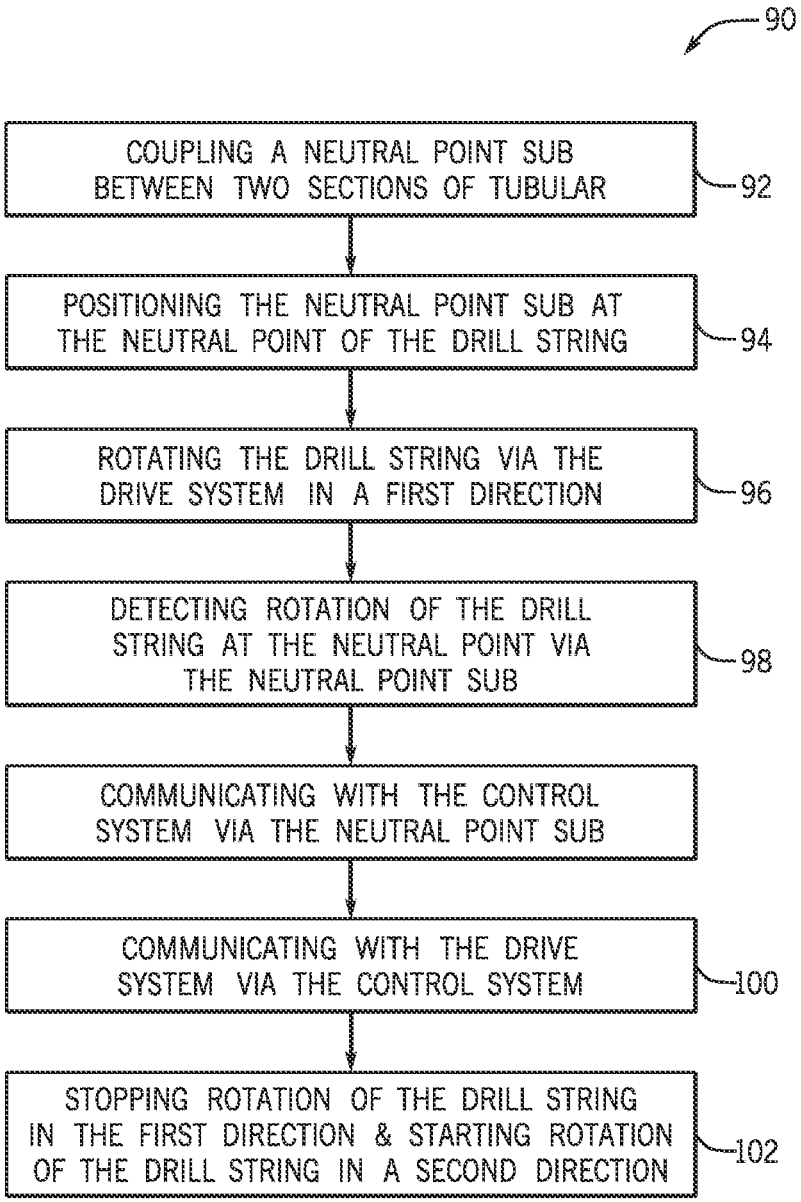
FIG. 3 is a process flow diagram of a method of detecting and controlling motion of a drill string with a neutral point sub in accordance with present embodiments.

Turning now to FIG. 3, an embodiment of a method 90 for detecting and controlling rotation of the drill string 28 is shown in a process flow diagram. The method includes coupling the neutral point sub 60 between two sections of tubular 38 on the drill string 28 (block 92). For example, the neutral point sub 60 may be threadably engaged on one end to a first section of tubular 38 and on the other end to a second section of tubular 38. The method 90 also includes positioning the neutral point sub 60 at the neutral point 62 of the drill string 28 (block 94). This step may be done in conjunction with the step disclosed in block 92. For example, the neutral point sub 60 may be threadably engaged between two sections of tubular 38 that are expected to be proximate the neutral point 62, such that the neutral point sub 60 is disposed at the neutral point 62 of the drill string 28. The method 90 also includes rotating the drill string 28 at the top of the drill string 28 via the top drive 40 or drive system in a first direction (block 96). For example, the top drive 40 may rotate the drill string 28 clockwise such that the rotations propagate through the drill string 28 downward. The method 90 further includes detecting rotation of the drill string 28 via the neutral point sub 60 at the neutral point 62 (block 98). For example, the rotation of the drill string 28 propagates through the drill string 28 from the top drive 40, but may dissipate over time due to elasticity of the drill string 28 and/or due to some frictional engagement of the drill string 28 with sides of the wellbore 30 or with mud flowing through the wellbore 30. Accordingly, multiple turns of the drill string 28 in, for example, the clockwise direction may take place before the neutral point sub 60 first detects rotation of the drill string 28 at the neutral point 62. The method 90 also includes communicating with the control system 50, via the neutral point sub 60, that rotation of the drill string 28 has occurred at the neutral point 62 (block 100). For example, the neutral point sub 60 may send an electric pulse or trigger a mud pulse for communicating with the control system 50. The method 90 further includes stopping rotation of the drill string 28 in, for example, the first direction (e.g., the clockwise direction) and starting rotation of the drill string 28 in a second direction (e.g., the counterclockwise direction), via communication between the control system 50 and the drive system (e.g., top drive) (block 102).

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A drilling system, comprising:

a drill string comprising two or more drill pipes;

a drive system configured to rotate the drill string about a longitudinal axis extending through the drill string;

a neutral point sub disposed proximate a neutral point of the drill string, wherein the neutral point sub is configured to detect rotation of the drill string proximate the neutral point sub; and a controller configured to control rotation of the drill string based on feedback transmitted to the controller from the neutral point sub, wherein the neutral point is positioned on the drill string such that the rotation of the drill string is detected by the neutral point sub and corrected for by the controller without an alteration of a drilling angle.

2. The system of claim 1, wherein the neutral point sub is disposed between two of the two or more drill pipes.

3. The system of claim 1, wherein the neutral point sub is coupled to at least one of the two or more pipes via a threaded engagement.

4. The system of claim 1, wherein feedback is transmitted from the neutral point sub to the controller via an electrical pulse, a mud pulse, or both.

5. The system of claim 1, comprising one or more subs disposed above the neutral point sub, wherein at least one of the one or more subs is also configured to detect rotation of the drill string and provide feedback to the controller.

6. The system of claim 1, wherein the drilling system comprises a vertical drilling system or a directional drilling system.

7. The system of claim 5, wherein the at least one of the one or more subs is configured to detect the rotation of the drill sting at a second neutral point of the drill string, wherein the second neutral point corresponds to a different position on the drill string than that of the neutral point, wherein the neutral point is derived from a first length of the drill string, and wherein the second neutral point is derived from a second length of the drill string different than the first length.

8. A method of controlling rotation of a drill string, the method comprising:

detecting rotation of the drill string at a neutral point of the drill string in a first circumferential direction via a neutral point sub disposed on the drill string;

instructing a drive system, via a controller, to stop rotating the drill string in the first circumferential direction after detecting the rotation of the drill string at the neutral point; and instructing the drive system, via the controller, to start rotating the drill string in a second circumferential direction opposite to the first circumferential direction after stopping the rotation in the first circumferential direction, wherein the neutral point is positioned on the drill string such that the rotation of the drill string is detected by the neutral point sub and corrected for by the controller without an alteration of a drilling angle.

9. The method of claim 8, comprising communicating detection of rotation of the drill string from the neutral point sub to the controller.

10. The method of claim 9, wherein the neutral point sub communicates with the controller via an electric pulse, a mud pulse, or both.

11. The method of claim 8, comprising instructing the drive system to rotate the drill string in the second circumferential direction a second number of turns equal to a first number of turns the drive system rotated the drill string in the first circumferential direction before the neutral point sub detected rotation of the drill string at the neutral point in the first circumferential direction.

12. The method of claim 11, comprising instructing the drive system, via the controller, to stop rotating the drill string in the second circumferential direction if the neutral point sub detects rotation of the drill string in the second circumferential direction or after reaching the second number of turns.

13. The method of claim 8, comprising detecting rotation of the drill string at at least two positions on the drill string spaced apart from the neutral point via at least two subs disposed on the drill string, wherein the at least two subs are configured to provide feedback to the controller.

14. A method of drilling a well, the method comprising: instructing a top drive, via a controller, to apply torque to a drill string in a first circumferential direction relative to a longitudinal axis extending through the drills string;

detecting rotation of the drill string at a neutral point of the drill string below the top drive via a neutral point sub;

sending a pulse, via the neutral point sub, to the controller to alert the controller that the neutral point sub has detected rotation of the drill string at the neutral point; processing the pulse via the controller; and instructing the top drive, via the controller, to apply torque to the drill string in a second circumferential direction relative to the longitudinal axis, wherein the second circumferential direction is substantially opposite the first circumferential direction, wherein the neutral point is positioned on the drill string such that the rotation of the drill string is detected by the neutral point sub and corrected for by the controller without an alteration of a drilling angle.

15. The method of claim 14, wherein the pulse comprises an electric pulse, a mud pulse, or both.

16. The method of claim 14, wherein the neutral point sub is disposed on the drill string between two pipes of the drill string.

17. The method of claim 14, comprising detecting rotation of the drill string at one or more locations above the neutral point via one or more corresponding detection subs.

18. The method of claim 17, comprising:

sending pulses from the one or more corresponding detection subs to the controller;

processing the pulses, via the controller, to determine an expected number of rotations needed to be applied via the drive system such that the drill string rotates up to, but not beyond, the neutral point.

19. The method of claim 18, wherein processing the pulses, via the controller, to determine the expected number of rotations needed to be applied via the drive system such that the drill string rotates up to, but not beyond, the neutral point comprises processing the pulses using a linear relationship between a number of turns applied to the drill string by the drive system and a distance along the drill string from the drive system to the subs supplying the pulses.

* * * * *